United States Patent [19]

Bergs

[11] 4,049,129

[45] Sept. 20, 1977

[54] AUTOMATIC COUPLING FOR STREETCARS AND THE LIKE

[75] Inventor: Olof Sune Bergs, Sundborn, Sweden

[73] Assignee: AB Dellner-Malmco, Falun, Sweden

[21] Appl. No.: 701,561

[22] Filed: July 1, 1976

[30] Foreign Application Priority Data

July 14, 1975 Sweden ..... 7508039

[51] Int. Cl.[2] ..... B61G 7/12

[52] U.S. Cl. ..... 213/4; 213/6; 213/74; 280/491 B

[58] Field of Search ..... 213/18, 16, 4, 5, 6, 213/74; 280/491 B, 491 R, 495, 498

[56] References Cited

U.S. PATENT DOCUMENTS

| | | | |
|---|---|---|---|
| 1,132,574 | 3/1915 | Giberson | 213/6 |
| 2,292,193 | 8/1942 | Blomberg | 213/4 |

FOREIGN PATENT DOCUMENTS

| | | | |
|---|---|---|---|
| 1,265,590 | 4/1968 | Germany | 280/491 B |
| 851,457 | 10/1957 | United Kingdom | |

*Primary Examiner*—Trygve M. Blix
*Assistant Examiner*—Gregory W. O'Connor
*Attorney, Agent, or Firm*—Brumbaugh, Graves, Donohue & Raymond

[57] ABSTRACT

An automatic coupling for streetcars and like vehicles comprises a connecting rod pivotally connected to the vehicle and a coupling head pivotally connected to the connecting rod. The coupling head is pivotally disposed in the horizontal plane between an operative position in an extension of the connecting rod, in which position the coupling head extends beyond the front profile of the vehicle, and an inoperative position beside the connecting rod, in which position the coupling head is located inside the front profile of the vehicle. The coupling head co-operates with a locking device, by means of which the coupling head may be locked to the connecting rod in the operative and inoperative positions.

4 Claims, 3 Drawing Figures

AUTOMATIC COUPLING FOR STREETCARS AND THE LIKE

The present invention relates to an automatic coupling for streetcars and similar rail-borne vehicles, the coupling comprising a connecting rod pivotally connected to the vehicle, and a coupling head pivotally connected to the connecting rod.

According to the invention, the coupling head is pivotal in the horizontal plane between an operative position in an extension of the connecting rod, in which position the coupling head projects beyond the front profile of the vehicle, and an inoperative position beside the connecting rod, in which position the coupling head is located inside the front profile of the vehicle. Moreover, the coupling head cooperates with a locking device, by means of which the coupling head may be locked to the connecting rod at least in the above-mentioned operative and inoperative positions. When the coupling head assumes its operative position, the automatic coupling functions normally and is, thus, totally independent of the ability of the coupling head to pivot. When the coupling head assumes its inoperative position, the coupling cannot cause any damage whatsoever, since the coupling head is located inside the front profile of the vehicle which is suitably provided with rubber fenders or the like. Consequently, the risk of damage caused by the coupling has been eliminated by the present invention.

The nature of the invention and its aspects will be more fully understood from the following description of the drawing and discussion relating thereto.

In the accompanying drawing which shows one embodiment of the automatic coupling according to the invention illustrated by way of example:

Figure 1:
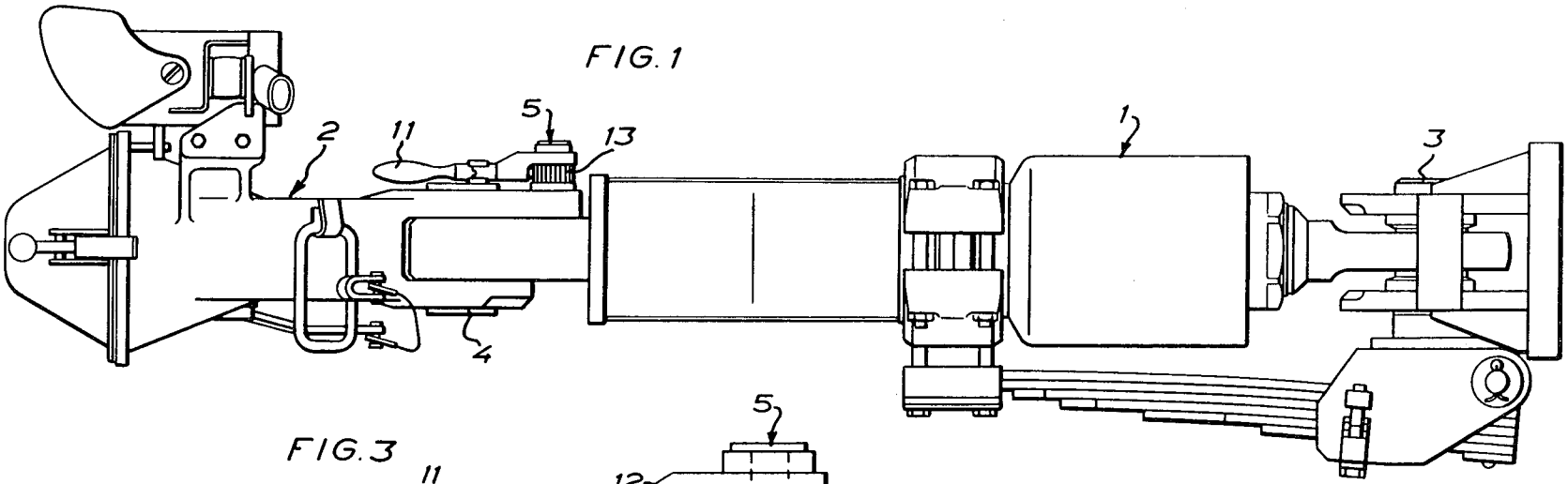
FIG. 1 shows the coupling seen from the side.

The automatic coupling shown on the drawing consists of a so-called Scharfenberg coupling. This consists of the connecting rod 1 and the coupling head 2. The connecting rod 1 is, at its inner end, pivotally connected to the streetcar or the like, the vertical pivot shaft being designated 3. The coupling head 2 is pivotally connected to the connecting rod 1 at the outer end thereof, the vertical pivot shaft being designated 4.

Figure 2:
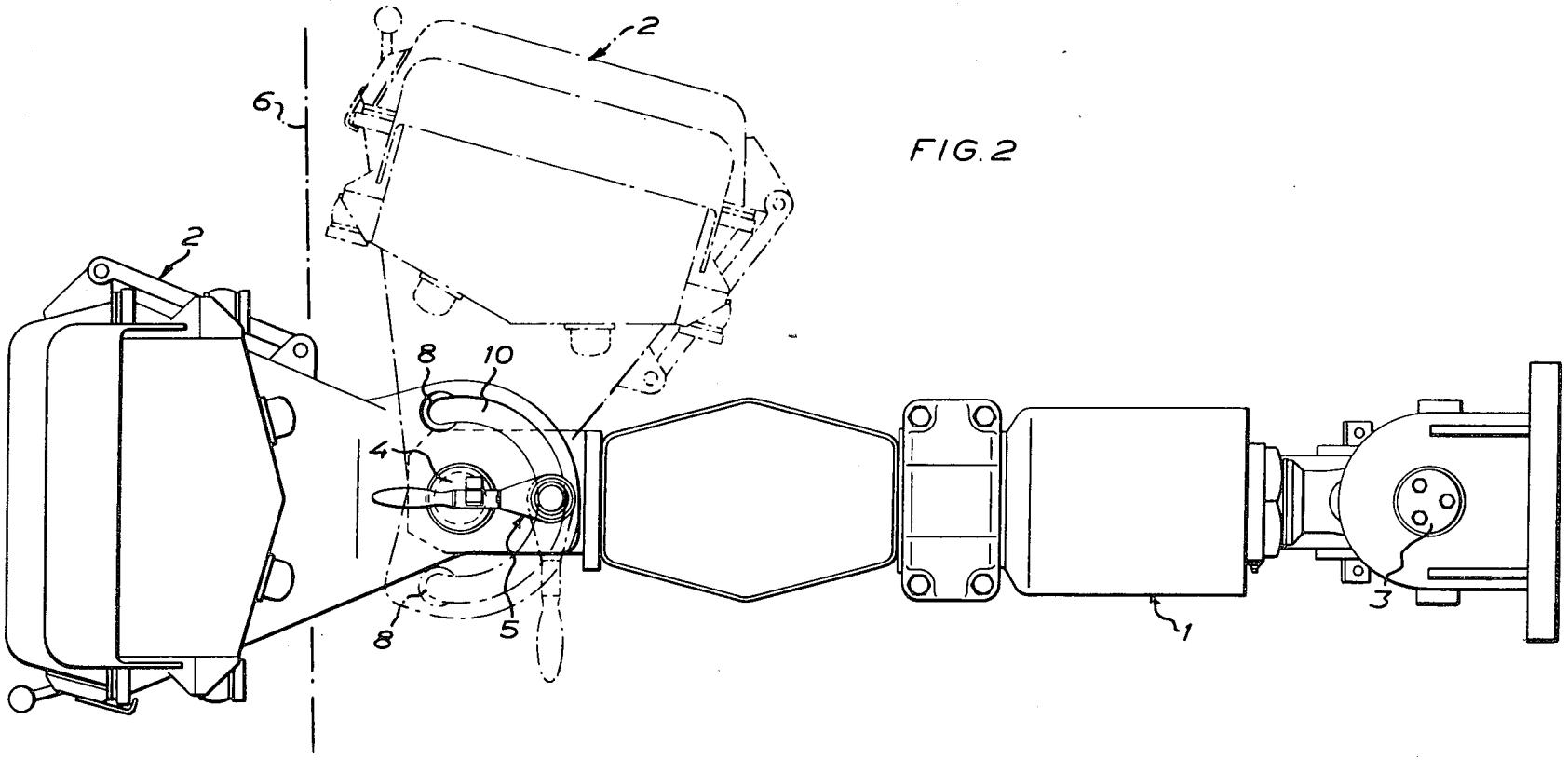
FIG. 2 shows the coupling seen from above.

The coupling head 2 is pivotal in the horizontal plane between an operative position in an extension of the connecting rod 1; this position being indicated by means of solid lines on the drawing; and an inoperative position beside the connecting rod 1; this position being indicated by means of dash-dot lines in FIG. 2.

The coupling head 2 cooperates with a locking device 5 by means of which the coupling head 2 may be locked to the connecting rod 1 at least in the above-mentioned operative and inoperative positions.

The front profile of the streetcar is intimated, in FIG. 2, by means of the dash-dot line 6. As is apparent from this drawing figure, the coupling head 2, projects in its operative position, beyond the front profile 6, whereas, in its inoperative position, the coupling head is located inside the front profile 6.

Figure 3:
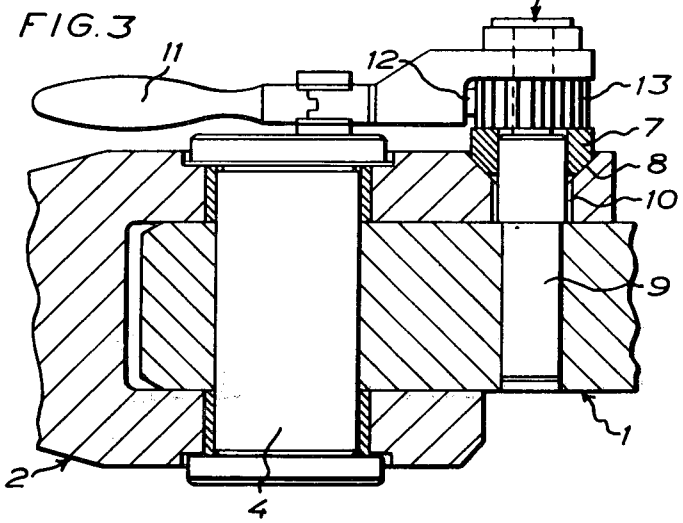
FIG. 3 shows the locking device of FIG. 1 on a larger scale and in cross-section.

The locking device 5 includes a cone 7 or the like, which, in the locking positions, may be lodged in corresponding recesses 8. As is most clearly apparent from FIG. 3, the connecting rod 1 is provided with a pin 9 which is fixedly connected to the coupling rod and extends through a groove 10 in the coupling head 2, the groove 10 being curved and having the shaft 4 as its center of curvature. The groove 10, which suitably covers 105°, is provided, at its end, with the recesses 8 corresponding to the locking positions, in which recesses the cone 7 may be lodged. The cone 7 is arranged on the pin 9 and cooperates, for the purposes of being lodged in position, with a thread on the pin 9.

A locking arm pivotally journaled on the pin 9 is designated 11 and is arranged, by means of a locking tooth 12, to engage in a cog wheel 13 cooperating with the thread of the pin 9. The cone 7 can be integral with the cog wheel 13. In another embodiment of the apparatus according to the present invention, the cone 7 can comprise a separate part which is located on the pin 9 inside the cog wheel 13. The locking tooth 12 is reversible so that the cone 7 is either pressed against the groove 10 or moved away therefrom when the locking arm 11 pivots reciprocally.

The invention should not be considered as restricted to that described above and shown on the drawing, many modifications being possible within the spirit and scope of the appended claims.

What I claim and desire to secure by Letters Patent is:

1. In an automatic coupling for streetcars and similar railborne vehicles, the coupling comprising:

a. a connecting rod pivotally connected to the vehicle; and b. a coupling head pivotally connected to the connecting rod, the improvement that the coupling head is pivotal in the horizontal plane between an operative position in an extension of the connecting rod, in which position the coupling head projects beyond the front profile of the vehicle, and an inoperative position beside the connecting rod, in which position the coupling head is located inside the front profile of the vehicle; and that the coupling head cooperates with a locking device by means of which the coupling head may be locked to the connecting rod at least in said operative and inoperative positions; said locking device including a cone or the like which, in the locking positions, may be lodged in corresponding recesses; said cone being lodgably connected to a pin provided on said connecting rod or said coupling head, said pin extending through a groove in said coupling head or said connecting rod, said groove being curved and having the pivotal center of the coupling head as its center of curvature, and said groove being provided with said recesses corresponding to said locking positions.

2. The automatic coupling of claim 1, wherein said recesses corresponding to said locking positions are located at the ends of said groove.

3. The automatic coupling of claim 1, wherein said cone cooperates with a thread on said pin for the purposes of lodging said cone in said recesses corresponding to said locking positions.

4. The automatic coupling of claim 3, wherein a locking arm provided with a locking tooth is pivotally journaled on said pin, said locking arm being arranged to engage with said locking tooth in a cog wheel cooperating with the thread of said pin.

* * * * *